United States Patent [19]

Heinemann et al.

[11] Patent Number: 4,778,381

[45] Date of Patent: Oct. 18, 1988

[54] RECIPROCATING GRATE DRIVE APPARATUS

[75] Inventors: Otto Heinemann, Ennigerloh; Heinz-Herbert Schmits, Rheda-Wiedenbrück, both of Fed. Rep. of Germany

[73] Assignee: Krupp Polysius AG, Beckum, Fed. Rep. of Germany

[21] Appl. No.: 86,050

[22] Filed: Aug. 17, 1987

[30] Foreign Application Priority Data

Sep. 19, 1986 [DE] Fed. Rep. of Germany ..... 3631974

[51] Int. Cl.[4] ..... F27D 15/02

[52] U.S. Cl. ..... 432/77; 432/78; 110/165 R

[58] Field of Search ..... 432/77, 78, 81, 82, 432/83

[56] References Cited

U.S. PATENT DOCUMENTS

| | | | |
|---|---|---|---|
| 2,084,976 | 6/1937 | Puerner | 432/78 |
| 3,358,385 | 12/1967 | Maberry | 432/77 |
| 4,147,503 | 4/1979 | Herchenbach et al. | 432/78 |
| 4,503,783 | 3/1985 | Musschoot | 432/78 |

*Primary Examiner*—Henry C. Yuen

*Attorney, Agent, or Firm*—Learman & McCulloch

[57] ABSTRACT

The invention relates to apparatus for driving a thrust grate cooler, in which the division of force is provided on the low-moment side between and electric motor and a reduction gear system. Such a construction is distinguished by substantially reduced expenditure on construction and manufacture.

5 Claims, 3 Drawing Sheets

RECIPROCATING GRATE DRIVE APPARATUS

BACKGROUND OF THE INVENTION

In the previously known apparatus for mechanically driving a reciprocating grate cooler, a variable-speed electric motor acts via a gear and a chain drive to rotate a heavy eccentric shaft from which two connecting rods move the grate axis of the thrust grate to and fro.

Thus in this known construction the division of the force is achieved on the high-moment side in the crankshaft, which requires high expenditure on construction and manufacture.

SUMMARY OF THE INVENTION

The object of this invention is to construct apparatus of this type in such a way that the expenditure on construction and manufacture is substantially reduced.

According to this invention the division of force is provided on the low-moment input side between an electric motor and reduction drives. Thus heavy and expensive eccentric shaft which was previously necessary for the division of force on the high-moment output side can be omitted.

THE DRAWINGS

Advantageous embodiments of the invention will be explained in greater detail below in connection with the embodiments illustrated in the drawings, wherein.

Figure 1:
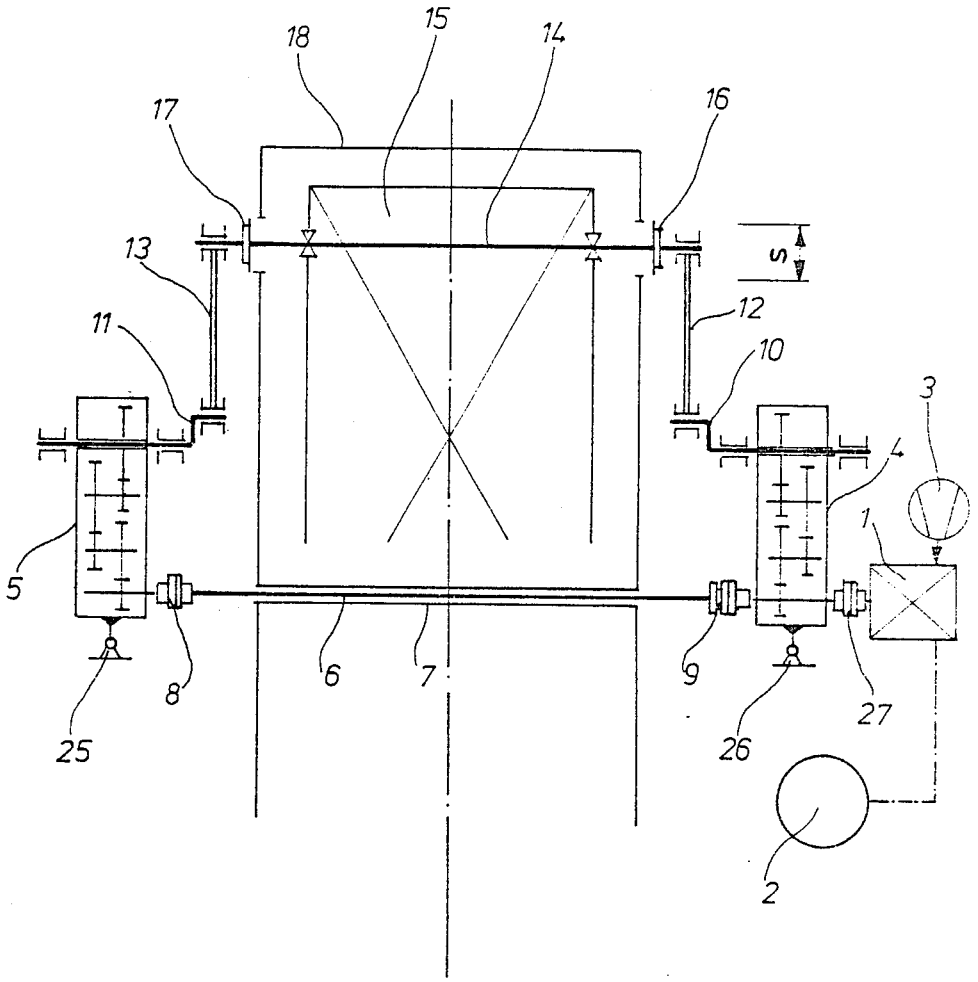
FIG. 1 is a fragmentary, diagrammatic plan view of one embodiment of drive apparatus according to the invention.

The apparatus illustrated in FIG. 1 for driving a thrust grate cooler contains a variable-speed electric motor 1, preferably a three-phase standard motor with a frequency converter 2 and a separate ventilator 3.

The reduction gear system is formed by two standard gear units 4, 5 which are coupled to each other on the input side via a transmitting shaft 6, enclosed in a protective pipe 7, and elastic couplings 8, 9, e.g. diaphragm couplings, which are resistant to torsion.

Crankshafts 10 and 11 are inserted into the bushes on the output side of each of the two gear units.

The shafts 10, 11 drive push rods 12, and 13 which are coupled to a drive shaft 14 which is firmly clamped in a swing frame 15. During its lifting movement (lift displacements) the swing frame 15 is guided by means of guide rollers 16, 17 relative to the cooler housing 18. Thus in the apparatus according to the invention illustrated in FIG. 1 the distribution of force is provided on the low-moment side between the electric motor 1 and the reduction gear system formed by the gear units 4 and 5.

To enable the two crankpins of the shafts 10 and 11 to be set so that they run synchronously, one half of the coupling 9 is fixed on the shaft 6 by means of a shrink-fit disc.

If the cooler is very wide the shaft 6 is advantageously divided.

Figure 2:
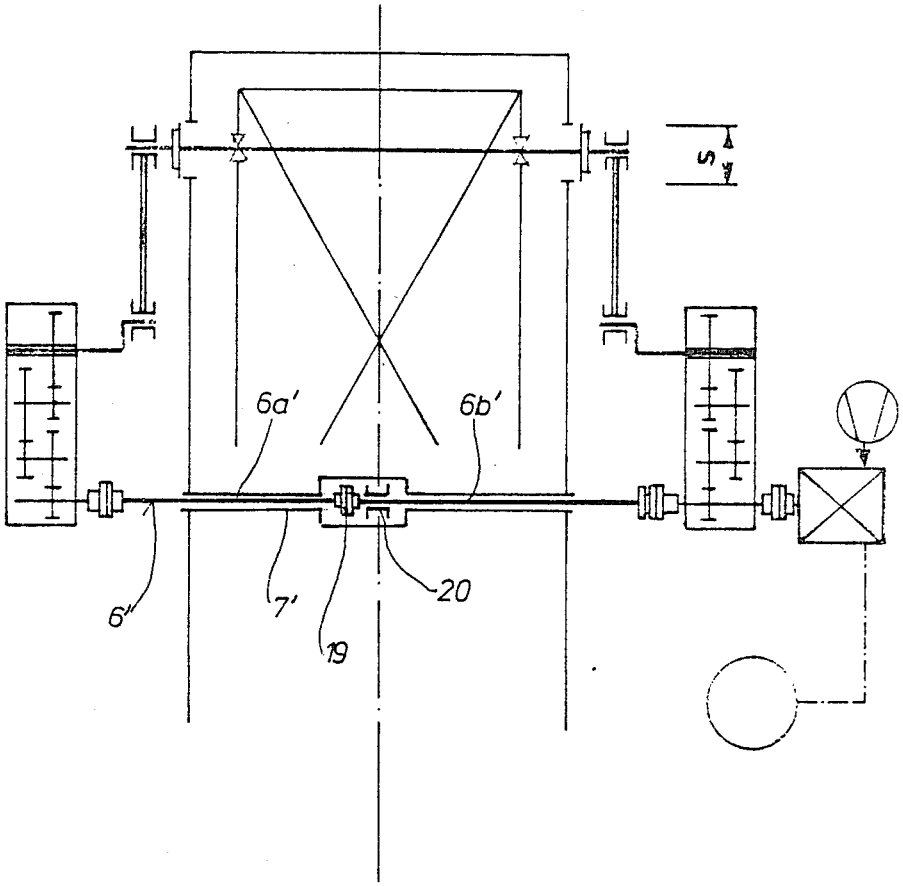
FIG. 2 is a view similar to FIG. 1, but illustrating a modified embodiment.

FIG. 2 shows a construction in which the shaft 6' is divided once, and the two adjacent shaft parts 6'a and 6'b are connected to one another by a coupling 19 which is resistant to rotation. In this construction a bearing 20 is generally necessary for the shaft 6'. The protective pipe 7' is constructed in such a way that it forms a protective box for both the coupling 19 and the bearing 20.

Figure 3:
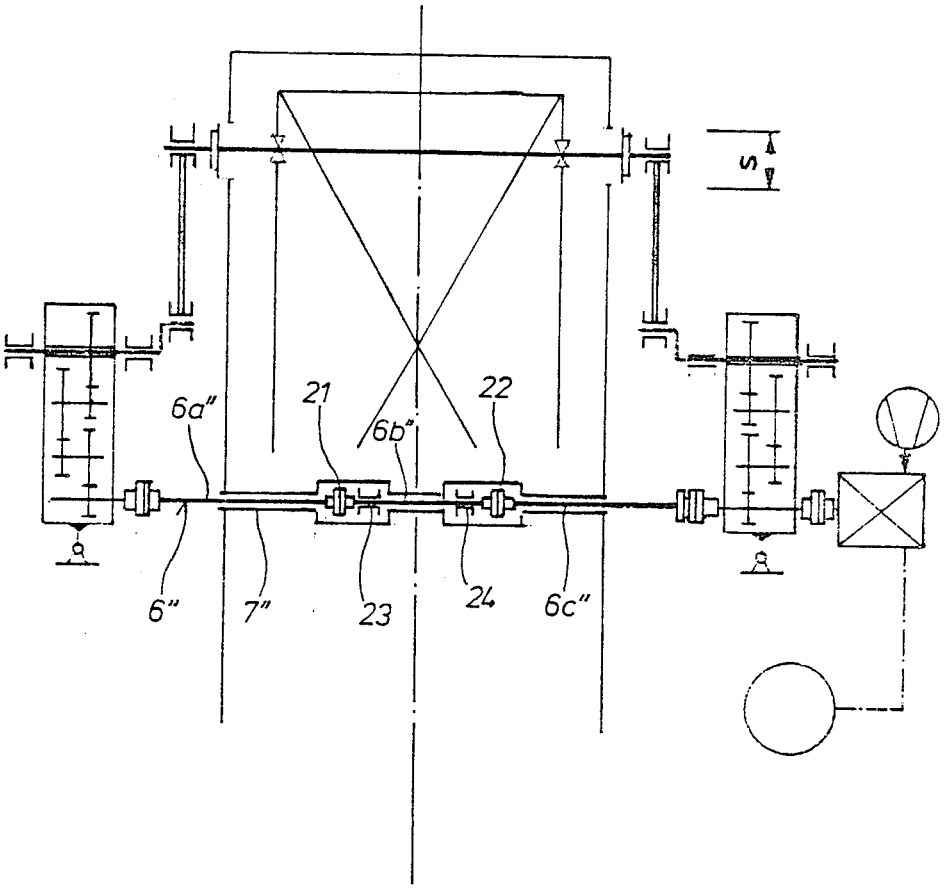
FIG. 3 is a view similar to FIG. 1, but illustrating a further modified embodiment.

In the embodiment according to FIG. 3, which is intended for very wide coolers, the shaft 6'' is divided at two points. The three-part connecting shaft therefore consists of the shaft adjacent parts 6''a, 6''b and 6''c which are connected to one another torsion resistant via couplings 21, 22. Two bearings 23, 24 serve for mounting of the shaft 6''. The protective pipe 7'' forms protective boxes for the couplings 21, 22 and the bearings 23, 24.

The push rods 12, 13 can be of one-part or multi-part construction in all the embodiments. In the case of two-part construction, the head bearings can be ready mounted on the crankpins of the shafts 10, 11 in the factory.

The gear units 4 and 5 are preferably constructed as multi-stage spur gears and provided with torque supports 25, 26. A further coupling 27 is provided between the electric motor 1 and the shaft 6.

What is claimed is:

1. Apparatus for driving a reciprocating cooler grate having a swing frame, said apparatus comprising a drive shaft journaled in and spanning said frame; a drive motor; first and second reduction gear units positioned respectively at opposite sides of said frame, each of said gear units having a relatively low moment input and a relatively high moment output; means coupling said motor to the relatively low moment input of one of said gear units; transmitting means coupling the relatively low input of one of said gear units to the relatively low input of the other of said gear units; and synchronous crank means coupling the relatively high moment output of each of said gear units to said drive shaft for rotating the latter, whereby rotation of said drive shaft effects reciprocation of said frame.

2. Apparatus according to claim 1 wherein said transmitting means comprises a driven shaft spanning said frame, and torsion resistant coupling means connecting said driven shaft to the relatively low moment input of each of said gear units.

3. Apparatus according to claim 2 wherein said torsion resistant coupling means is shrink fitted to said driven shaft.

4. Apparatus according to claim 1 wherein said transmitting shaft is composed of a plurality of adjacent parts each of which is coupled to its adjacent part by torsion resistant coupling means.

5. Apparatus according to claim 1 wherein said drive motor is a variable speed motor.

* * * * *

UNITED STATES PATENT AND TRADEMARK OFFICE

CERTIFICATE OF CORRECTION

PATENT NO. : 4,778,381

DATED : October 18, 1988

INVENTOR(S) : Heinemann et al

It is certified that error appears in the above-identified patent and that said Letters Patent is hereby corrected as shown below:

Column 1, line 9, change "thrust" to -- reciprocating --

Signed and Sealed this

Fourth Day of April, 1989

*Attest:*

*Attesting Officer*

DONALD J. QUIGG

*Commissioner of Patents and Trademarks*